US011559460B2

(12) United States Patent
Chiu

(10) Patent No.: US 11,559,460 B2
(45) Date of Patent: Jan. 24, 2023

(54) COMPRESSION DEVICE

(71) Applicant: Gary Chiu, Richardson, TX (US)

(72) Inventor: Gary Chiu, Richardson, TX (US)

( * ) Notice: Subject to any disclaimer, the term of this patent is extended or adjusted under 35 U.S.C. 154(b) by 994 days.

(21) Appl. No.: 16/288,463

(22) Filed: Feb. 28, 2019

(65) Prior Publication Data

US 2020/0276077 A1 Sep. 3, 2020

(51) Int. Cl.
*A61H 9/00* (2006.01)

(52) U.S. Cl.
CPC ..... *A61H 9/0078* (2013.01); *A61H 9/0007* (2013.01); *A61H 2201/0103* (2013.01); *A61H 2201/165* (2013.01); *A61H 2201/50* (2013.01); *A61H 2205/106* (2013.01)

(58) Field of Classification Search
CPC ..... A61H 9/0078; A61H 9/0007; A61H 2201/0103; A61H 2201/165; A61H 9/005; A61H 3/00; A61H 7/00; A61H 2205/06; A61H 2205/10; A61H 2209/00
See application file for complete search history.

(56) References Cited

U.S. PATENT DOCUMENTS 5,478,119 A * 12/1995 Dye ..... A61H 9/0078 285/914
5,575,762 A * 11/1996 Peeler ..... A61H 9/0078 601/152
8,591,439 B1 * 11/2013 Flood ..... A61H 31/00 601/150
10,149,796 B1 * 12/2018 Souney ..... A61H 1/00
10,219,972 B1 * 3/2019 Stockton ..... A61H 1/006
2004/0054306 A1 * 3/2004 Roth ..... A61H 9/0078 601/152
2004/0106884 A1 * 6/2004 Bolam ..... A61H 9/0078 601/152
2005/0187500 A1 * 8/2005 Perry ..... A61H 9/0007 601/150
2010/0081974 A1 * 4/2010 Vess ..... A61H 23/04 601/149
2011/0098611 A1 * 4/2011 Flood ..... A61H 31/00 601/149
2011/0201981 A1 * 8/2011 Deshpande ..... A61H 23/04 601/150

(Continued)

*Primary Examiner* — Samchuan C Yao
*Assistant Examiner* — Tyler A Raubenstraw
(74) *Attorney, Agent, or Firm* — Muncy, Geissler, Olds & Lowe, P.C.

(57) ABSTRACT

A compression device has a main body and a wrap. The main body has an air pump and a valve assembly. The valve assembly has a manifold, multiple first valves, and multiple air connectors. The manifold connects the air pump and the first valves. The air connectors are connected to the first valves respectively. The wrap is used for wrapping a human limb and has an air bag. The air bag has multiple pockets. The pockets are isolated from each other and connected to the air connectors respectively. Thus, each pocket can compress a part of the human limb independently. With the independent pockets, the compression device may compress a specified part of the human limb rather than the whole wrapped human limb. Moreover, with the pockets independently compressing and relaxing, the wrapped human limb may experience a massage, which helps the wrapped human limb to relax and recover.

17 Claims, 10 Drawing Sheets

(56) References Cited

U.S. PATENT DOCUMENTS

| | | | | |
|---|---|---|---|---|
| 2013/0014324 | A1* | 1/2013 | Receveur | A61G 7/05769 5/691 |
| 2013/0233531 | A1* | 9/2013 | Chiu | A61F 7/02 165/281 |
| 2013/0338553 | A1* | 12/2013 | Eddy | A61H 9/0078 601/150 |
| 2014/0094726 | A1* | 4/2014 | Malhi | A61H 9/0078 601/152 |
| 2014/0200464 | A1* | 7/2014 | Webster | A61B 17/1355 601/150 |
| 2014/0276271 | A1* | 9/2014 | Stryker | A61H 23/04 601/107 |
| 2014/0290795 | A1* | 10/2014 | Shih | A61H 9/0078 141/94 |
| 2015/0141887 | A1* | 5/2015 | Kawashima | F16K 11/22 601/149 |
| 2015/0224012 | A1* | 8/2015 | Wright | A61H 9/0078 601/150 |
| 2015/0231022 | A1* | 8/2015 | Shaltis | A61H 9/0092 601/149 |
| 2016/0100793 | A1* | 4/2016 | Barak | A61B 5/4519 600/301 |
| 2016/0206500 | A1* | 7/2016 | Steinlauf | A61H 9/0078 |
| 2016/0317370 | A1* | 11/2016 | Evans | G05B 15/02 |
| 2017/0172838 | A1* | 6/2017 | Brosnan | A61H 9/0078 |
| 2017/0181921 | A1* | 6/2017 | Wren | A61H 11/00 |
| 2018/0098707 | A1* | 4/2018 | Salamon | A61B 5/0261 |
| 2018/0161199 | A1* | 6/2018 | Chiu | A61F 7/0085 |
| 2019/0133873 | A1* | 5/2019 | Chase | A61H 9/0078 |
| 2019/0183673 | A1* | 6/2019 | Chiu | A61H 39/06 |

* cited by examiner

COMPRESSION DEVICE

BACKGROUND OF THE INVENTION

1. Field of the Invention

The present invention relates to a device for physiotherapy, especially to a device for compression.

2. Description of the Prior Arts

A conventional compression device has a main body, multiple tubes, and a wrap. The tubes connect the main body and the wrap. The main body has a case and an air pump. The air pump is mounted in the case and connected with the wrap via the tubes. The air pump is configured to draw air into the wrap through the tubes. Therefore, with the wrap covering a human limb, the air pumped into the wrap can compress the covered part of the human limb. Usually, the compression device may be used with a water bag. The water bag contains water and ice and may be arranged between the wrap and the human limb. Thus, the covered part of the human limb is compressed and cooled.

Because dimensions at different parts of the human limb differ, the proper exerted pressure should be correspondingly different. However, the wrap only has one air bag extending in the whole wrap, so the pressure exerted on the human limb is unitary. Therefore, the conventional compression device may not provide suitable pressure for each part of the human limb. Even though some wraps of some conventional compression devices have multiple air bags, the multiple air bags are still connected to the same air pump, so the pressures in the multiple air bags are still the same. To control the pressure in each air bag independently, each one of the air bags may be connected to a respective air pump; however, it makes the device heavy and cumbrous.

To overcome the shortcomings, the present invention provides a compression device to mitigate or obviate the aforementioned problems.

SUMMARY OF THE INVENTION

The main objective of the present invention is to provide a compression device that can compress a human limb via independent pockets The compression device has a main body and a wrap. The main body has an air pump and a valve assembly. The valve assembly is connected to the air pump and has a manifold, a plurality of first valves, and a plurality of air connectors. The manifold is connected to the air pump and has an inlet and a plurality of outlets. The inlet is connected to the air pump. The outlets communicate with the inlet. The first valves are connected to the outlets respectively. The air connectors are connected to the first valves respectively. The wrap is configured to wrap a human limb and has an air bag. The air bag forms an enclosed inner space to wrap the human limb and has a plurality of pockets. The pockets are isolated from each other and connected to the air connectors respectively.

Consequently, the compression device of the present invention has multiple pockets isolated from each other, so each pocket can compress a specific portion of a limb independently. With the independent pockets, the compression device may compress a specified part of the limb rather than the whole wrapped limb. Moreover, with the pockets independently compressing and relaxing, the wrapped limb may experience a massage, which helps the wrapped limb to relax and recover.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
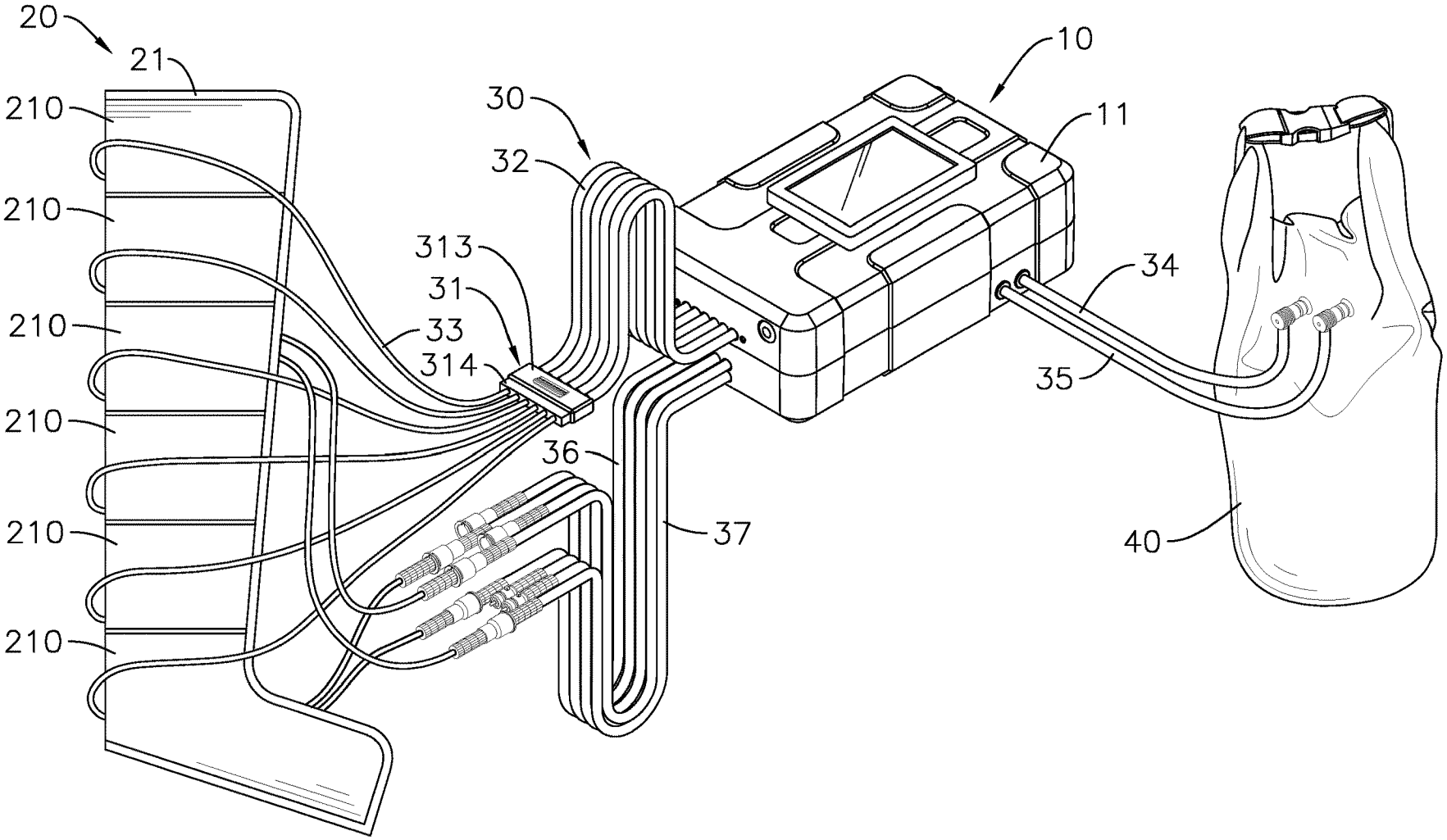
FIG. 1 is a perspective view of a compression device in accordance with a first embodiment of the present invention.

Please refer to FIG. 1. The compression device is capable of compressing and massaging a human limb. In the first embodiment, the compression device comprises a main body 10, at least one wrap 20, and a tube assembly 30, and selectively comprises a reserving bag 40.

Figure 2:
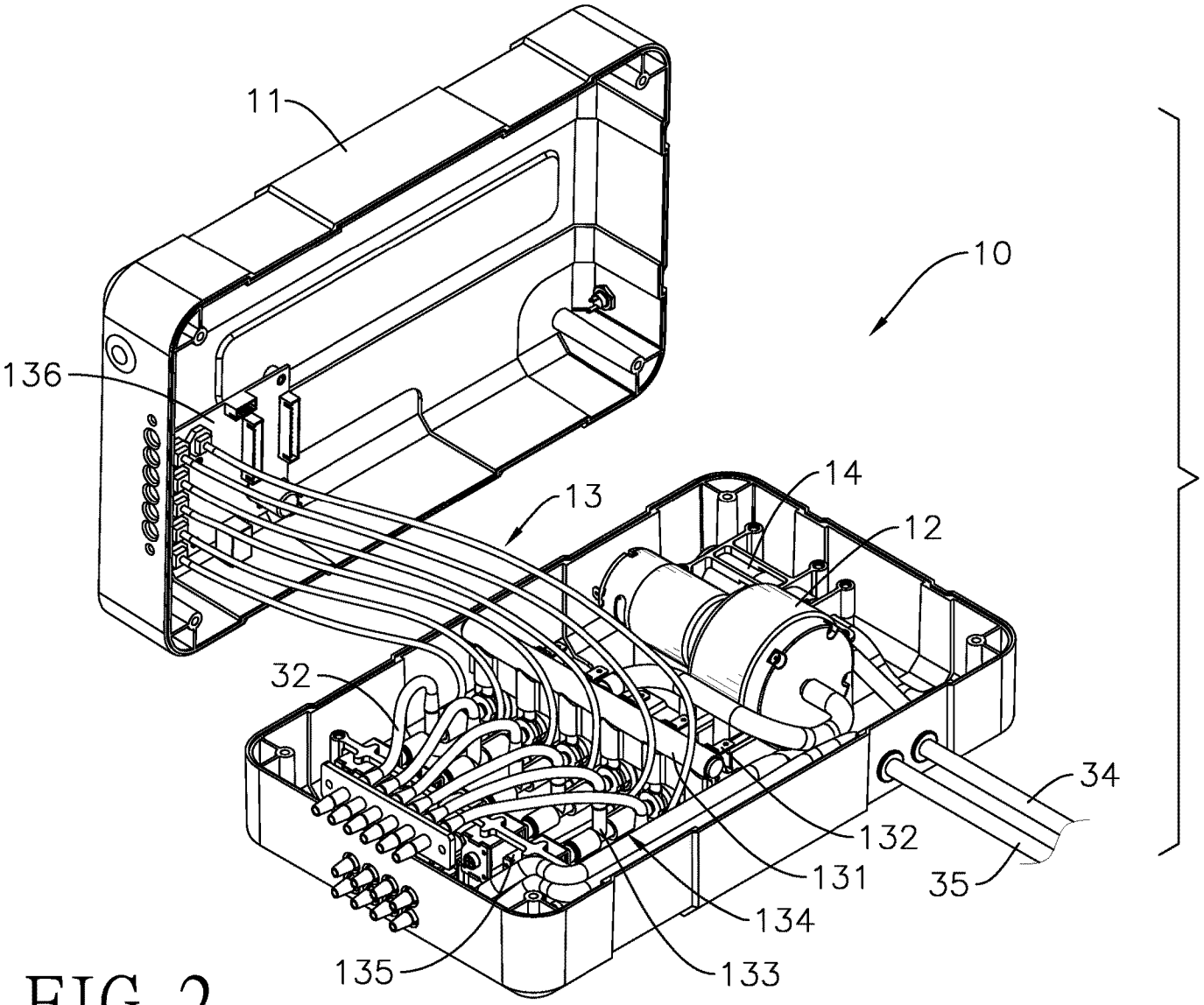
FIG. 2 is a perspective view inside a main body of the compression device in FIG. 1.
Figure 3:
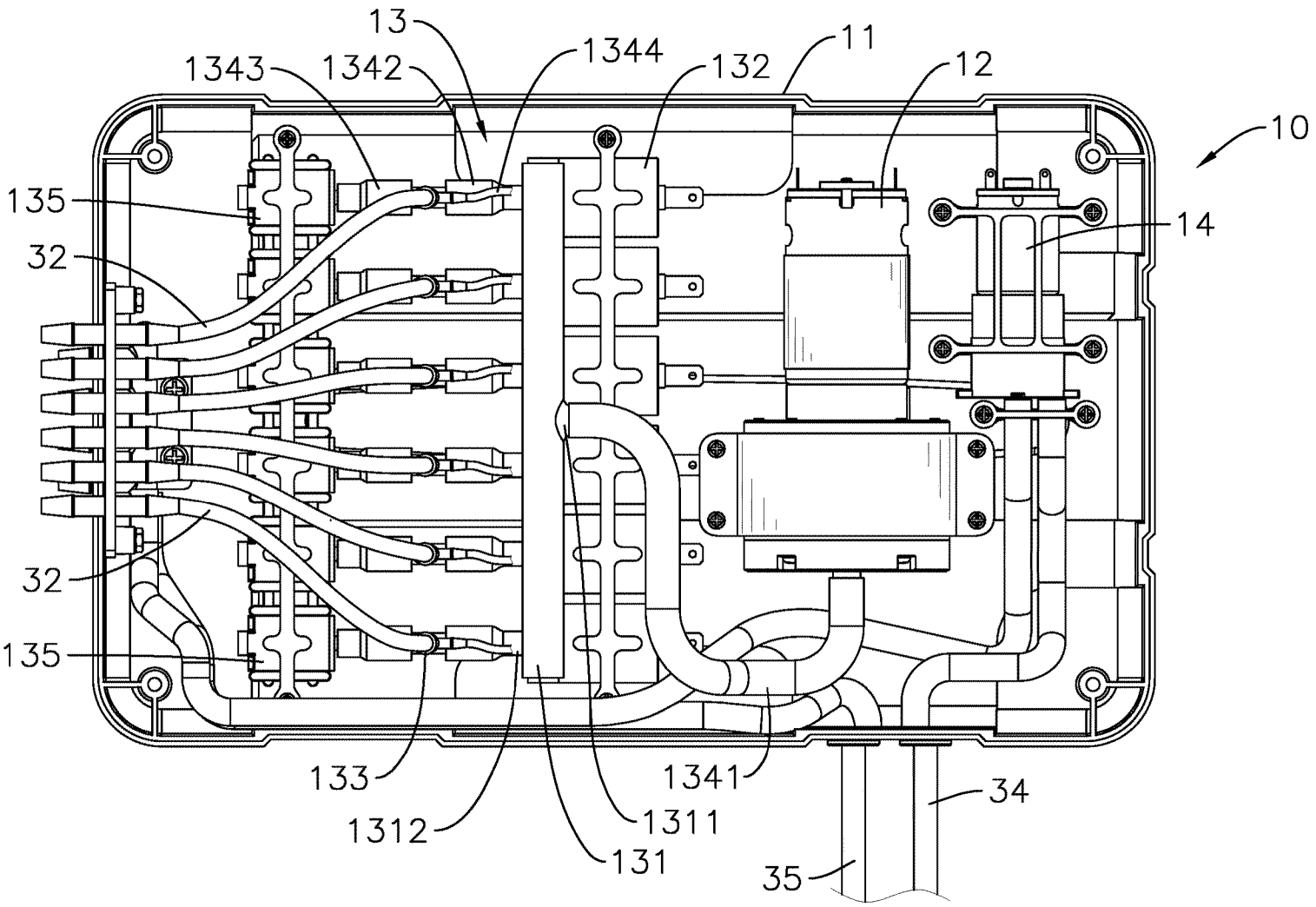
FIG. 3 is a top view inside the main body of the compression device in FIG. 1.
Figure 4:
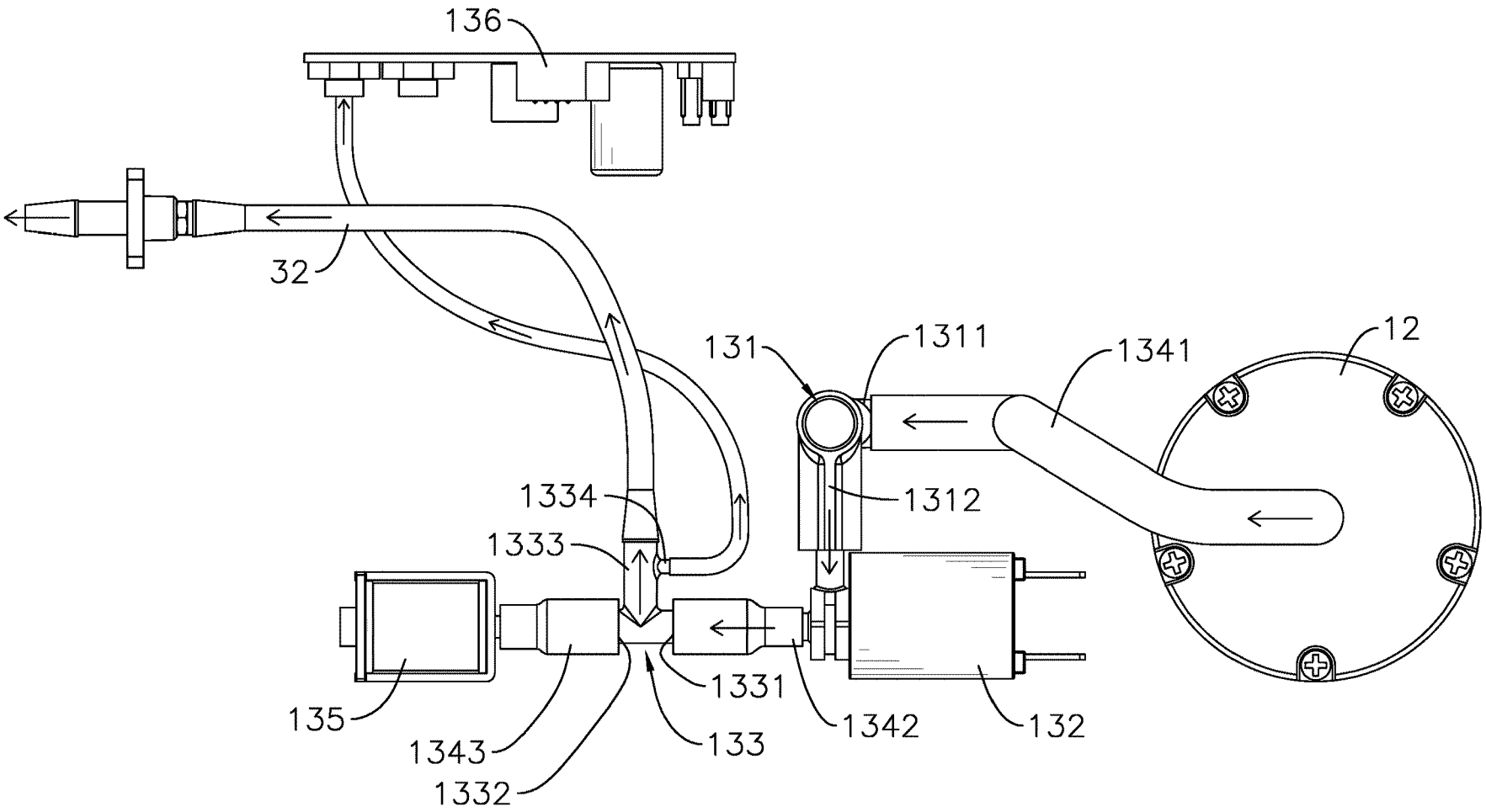
FIG. 4 is a side view of a valve assembly of the compression device in FIG. 1 when compressing.
Figure 5:
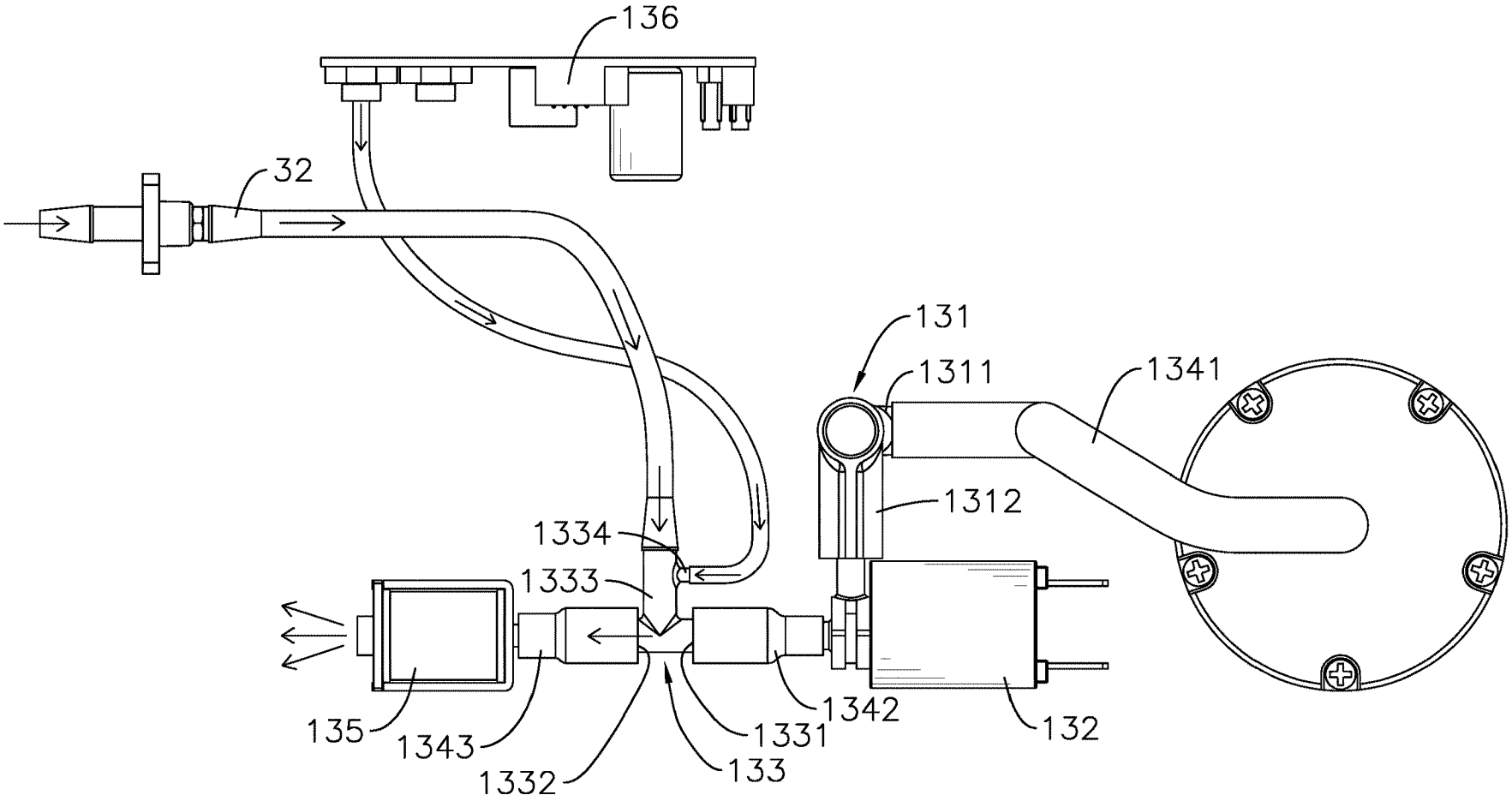
FIG. 5 is a side view of the valve assembly of the compression device in FIG. 1 when relaxing.

Then please refer to FIGS. 2 to 4. The main body 10 comprises a case 11, an air pump 12, and a valve assembly 13, and selectively comprises a water pump 14. The air pump 12, the valve assembly 13, and the water pump 14 may be mounted in the case 11. The embodiment that has the reserving bag 40 may have the water pump 14 as well.

The valve assembly 13 is connected to the air pump 12 and comprises a manifold 131, a plurality of first valves 132, a plurality of air connectors 133, and a conduit assembly 134, and selectively comprises a plurality of second valves 135 and a controller 136. The manifold 131 is connected to and communicates with the air pump 12 via the conduit assembly 134. The manifold 131 comprises an inlet 1311 and a plurality of outlets 1312, the inlet 1311 is connected to and communicates with the air pump 12 via the conduit assembly 134, and the plurality of outlets 1312 communicate with the inlet 1311. In this embodiment, the conduit assembly 134 has a main conduit 1341 and two ends of the main conduit 1341 are mounted on the manifold 131 and the air pump 12 respectively; alternatively, in another embodiment, the inlet 1311 of the manifold 131 may be mounted on the air pump 12.

Each one of the first valves 132 is a normally closed valve. Each one of the first valves 132 is connected to and communicates with a respective one of the outlets 1312 of the manifold 131 via the conduit assembly 134. In this embodiment, the first valves 132 may be mounted on the outlets 1312 of the manifold 131 respectively; alternatively, in another embodiment, the conduit assembly 134 has a plurality of conduits and two ends of each conduit are each mounted on a respective one of the first valves 132 and a respective one of the outlets 1312 of the manifold 131. The type of the first valves 132 is not limited thereto.

Each one of the air connectors 133 is a multiple-way connector. In a basic embodiment, the air connectors 133 are two-way connectors for connecting the air pump 12 and the wrap 20; however, in this embodiment, for facilitating accurate controlling, the air connectors 133 are four-way connectors, but it is not limited thereto. Each air connector 133 has a first branch 1331, a second branch 1332, a third branch 1333, and a tributary 1334, and the first branch 1331, the second branch 1332, the third branch 1333, and the tributary 1334 communicate with each other. Therefore, pressures in the first branch 1331, the second branch 1332, the third branch 1333, and the tributary 1334 are the same. In this embodiment, the first branch 1331 and the second branch 1332 are arranged in a line, the third branch 1333 is perpendicular to the first branch 1331 and the second branch 1332, and the tributary 1334 is mounted on and communicates with the third branch 1333.

The first branch 1331 of each air connector 133 is connected to and communicates with a respective one of the first valves 132 via the conduit assembly 134. In this embodiment, the conduit assembly 134 has a plurality of first conduits 1342 and two ends of each first conduit 1342 are respectively mounted on a respective one of the first branches 1331 and a respective one of the first valves 132; alternatively, in another embodiment, the first branches 1331 may be mounted on the first valves 132 respectively.

Each second valve 135 is connected to and communicates with a respective one of the air connectors 133 via the conduit assembly 134, and selectively communicates with an exterior environment. In this embodiment, the conduit assembly 134 has a plurality of second conduits 1343 and two ends of each second conduit 1343 are respectively mounted on a respective one of the second valves 135 and the second branch 1332 of a respective one of the air connectors 133; alternatively, in another embodiment, the second valves 135 may be mounted on the second branches 1332 respectively. In other words, each second branch 1332 is connected to and communicates with a respective one of the second valves 135. Each one of the second valves 135 is a normally open valve in this embodiment, but the type of the second valves 135 is not limited thereto.

The controller 136 is capable of controlling the first valves 132 and the second valves 135 to open and close independently. The controller 136 is connected to and communicates with the air connectors 133 via the conduit assembly 134, and thereby the controller 136 has at least one pressure sensor configured to detect pressures in the air connectors 133. In this embodiment, the controller 136 has a plurality of pressure sensors, but it is not limited thereto. The conduit assembly 134 has a plurality of third conduits 1344 and two ends of each third conduit 1344 are respectively mounted on the pressure sensor and the tributary 1334 of a respective one of the air connectors 133; alternatively, in another embodiment, the controller 136 may be mounted on all of the tributaries 1334 directly. In other words, the tributaries 1334 are connected to the controller 136.

The third branch 1333 of each air connector 133 is connected to the wrap 20 via the tube assembly 30.

Then please refer to FIGS. 1 and 4. The wrap 20 is configured to wrap a human limb. In this embodiment, the wrap 20 is configured to wrap 20 a human leg, so a contour of the wrap 20 corresponds to a contour of the foot. The wrap 20 comprises an air bag 21 and a water bag 22 and forms an inner space to receive a human limb. The air bag 21 is configured to form and enclose the inner space, and a contour of the air bag 21 corresponds to a contour of the wrapped part of the human limb, e.g. foot. In another embodiment, the contour of the air bag 21 may match a palm, an arm, or a trunk of the human limb. The wrap 20 may comprise a zipper mounted on the contour of the air bag 21 so that the wrap 20 can be expanded and receive the human limb easier. The air bag 21 has a plurality of pockets 210. The pockets 210 are isolated from each other. In this embodiment, the pockets 210 are arranged in a line and each one of the pockets 210 is capable of enclosing a part of the human limb; however, in another embodiment, the pockets 210 may be divided into multiple groups arranged in a line, and each group has multiple pockets 210 surrounding a part of the human limb so that each group encloses the part of the human limb. Each one of the pockets 210 is connected to and communicates with the third branch 1333 of a respective one of the air connectors 133 via the tube assembly 30.

The water bag (not shown in the drawings) is mounted on an inner wall of the inner space of the air bag and is connected to the water pump 14. Therefore, when the wrap 20 is wrapped on the human limb, the water bag contacts the wrapped human limb. The water bag comprises a bag body (not shown in the drawings) and a plurality of partitions (not shown in the drawings). The partitions are mounted in the bag body, and thereby a space in the bag body forms a flow path. In this embodiment, the flow path is a winding path to allow water to flow in the bag body for a longer time period and a longer distance.

The please refer to FIGS. 1 and 2. The reserving bag 40 is connected to and communicates with the water pump 14 via the tube assembly 30. Rather than a reserving tank with a hard case, the reserving bag 40 is flexible, so that when empty, the reserving bag 40 can be folded which facilitates storage.

Figure 6:
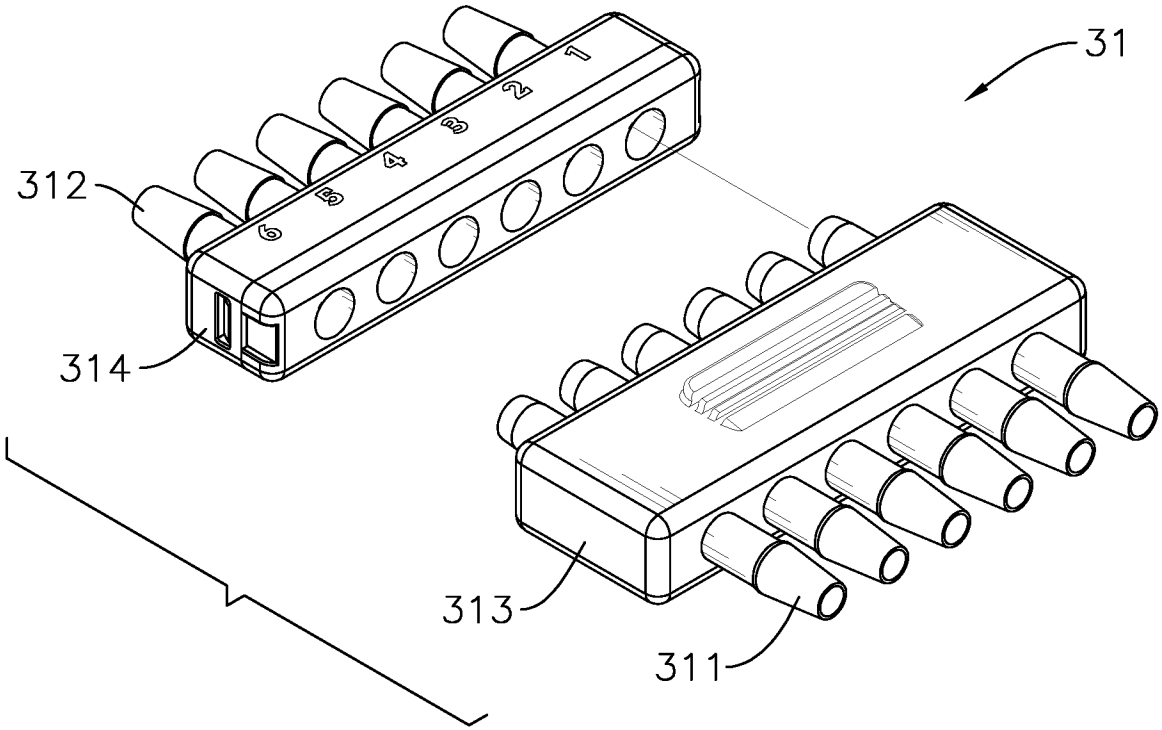
FIG. 6 is an exploded view of an integration connector of the compression device in FIG. 1.
Figure 7:
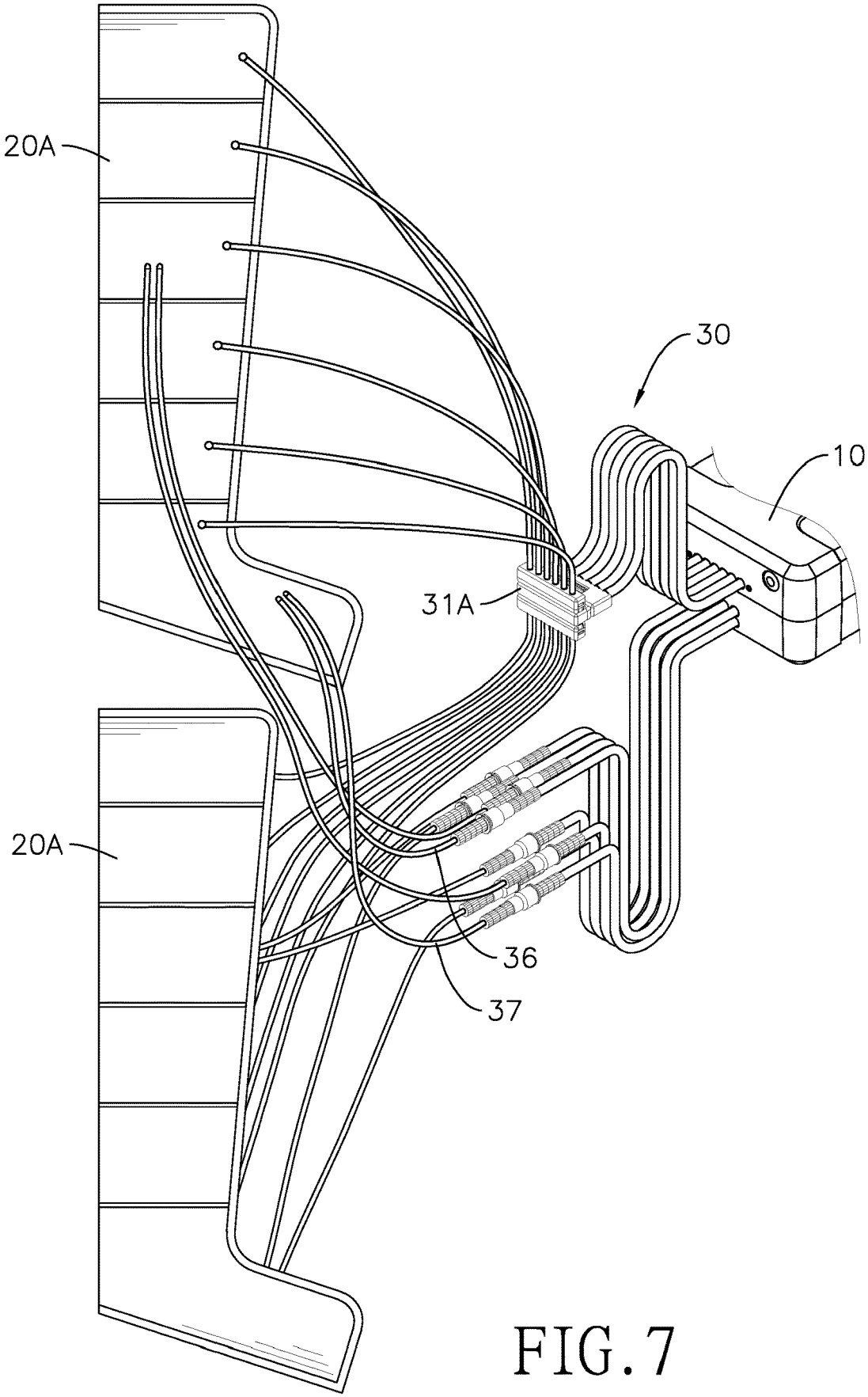
FIG. 7 is a perspective view of a compression device in accordance with a second embodiment of the present invention.
Figure 8:
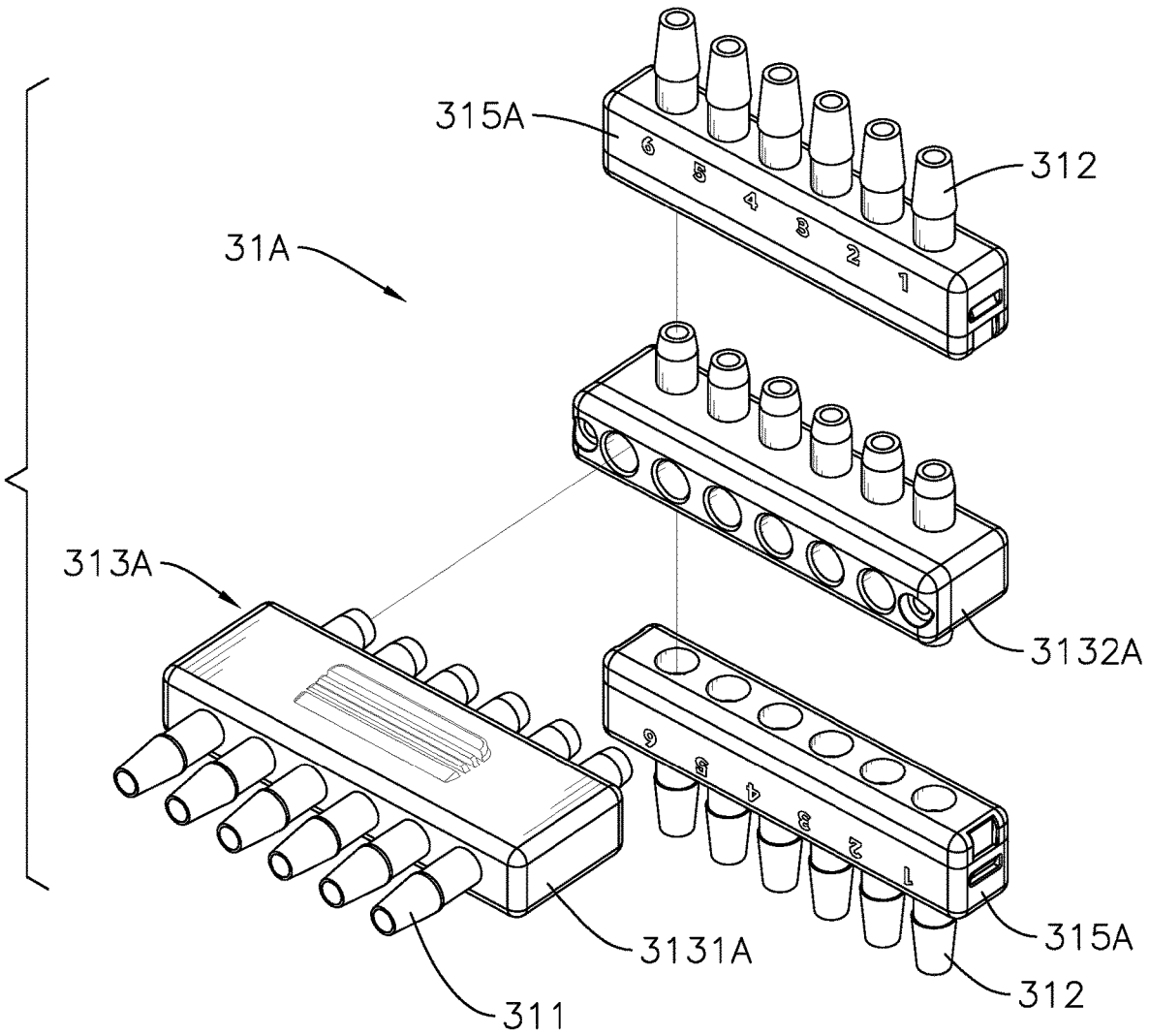
FIG. 8 is an exploded view of an integration connector of the compression device in FIG. 7.
Figure 9:
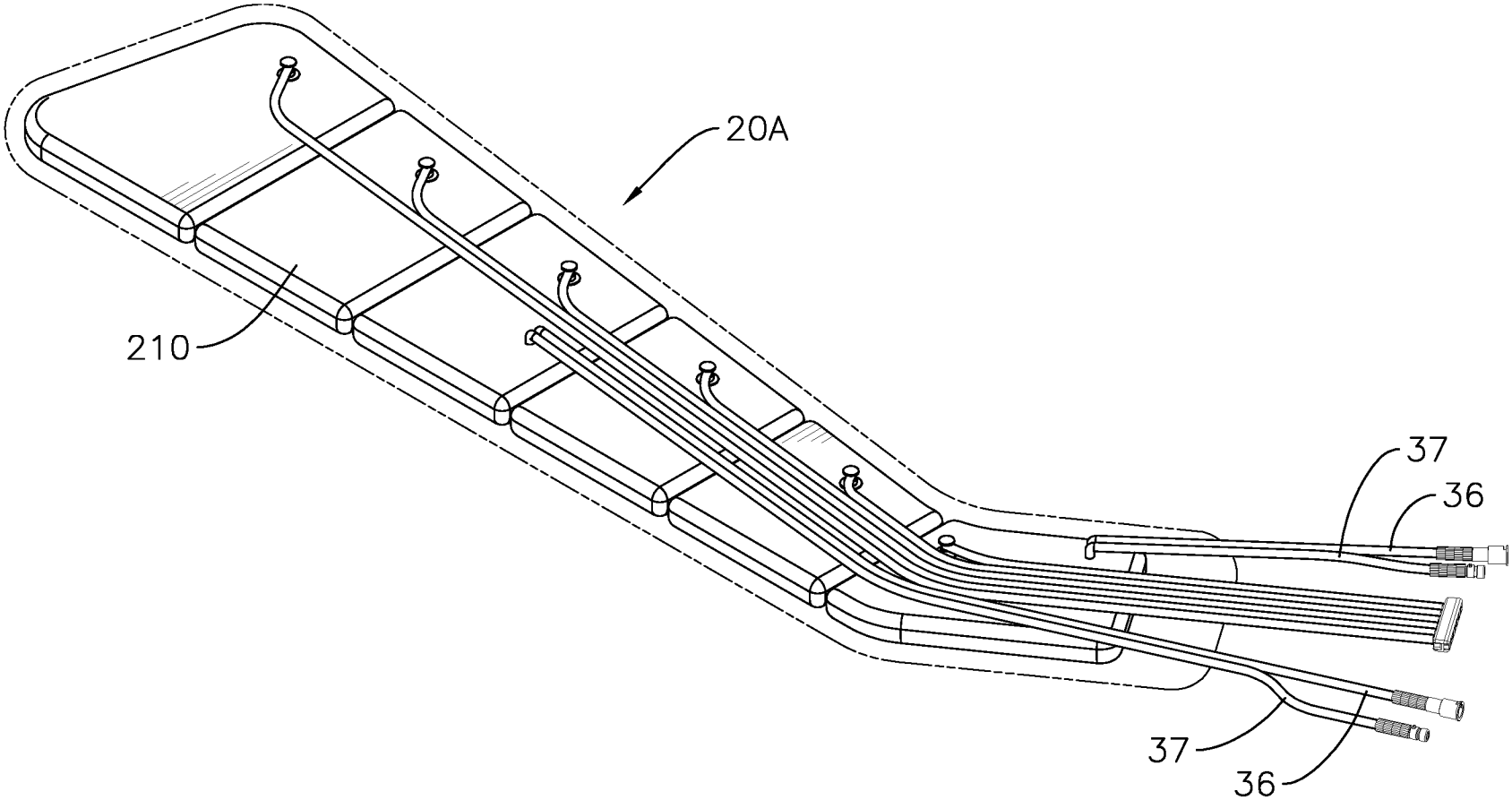
FIG. 9 is a side view of a wrap of the compression device in FIG. 7.
Figure 10:
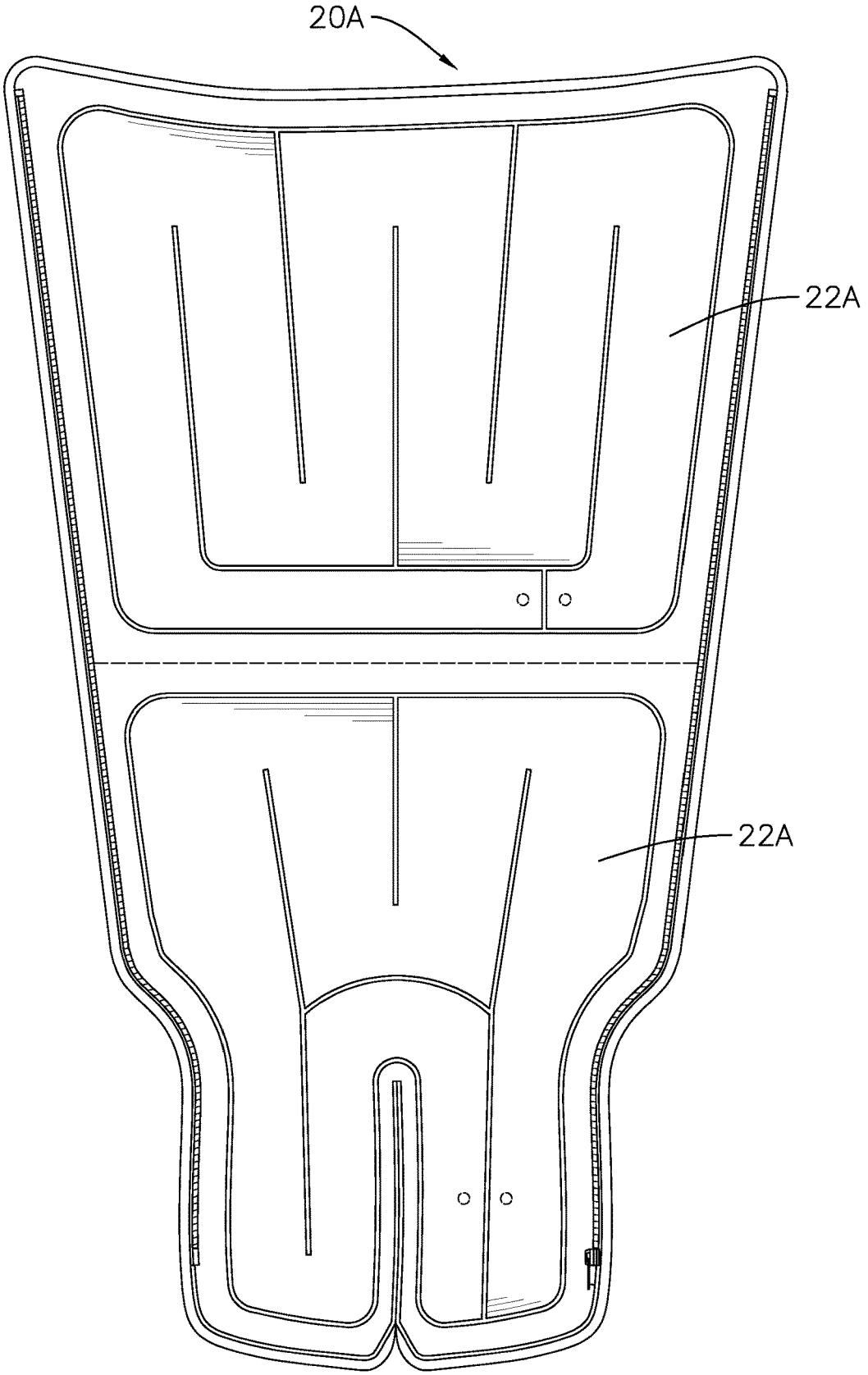
FIG. 10 is an expanded view of the wrap of the compression device in FIG. 7.

The please refer to FIGS. 1 and 6. The tube assembly 30 includes an integration connector 31, a plurality of first tubes 32, a plurality of second tubes 33, a drawing tube 34, a draining tube 35, at least one inlet tube 36, and at least one outlet tube 37.

The integration connector 31 comprises a plurality of first spouts 311 and a plurality of second spouts 312, and each one of the second spouts 312 communicates with a respective one of the first spouts 311. The integration connector 31 selectively comprises a first part 313 and a second part 314, and the first part 313 is detachably mounted on the second part 314. However, in another embodiment, the first part 313 may be securely mounted on the second part 314, or the first part 313 and the second part 314 are formed integrally. The first spouts 311 are mounted on the first part 313 and the second spouts 312 are mounted on the second part 314, so that the first spouts 311 and the second spouts 312 selectively communicate with each other.

One end of each first tube 32 is connected and communicates with the third branch 1333 (as shown in FIG. 4) of a respective one of the air connectors 133 and an opposite end of each first tube 32 is connected and communicates with a respective one of the first spouts 311. One end of each second tube 33 is connected and communicates with a respective one of the pockets 210 and an opposite end of each second tube 33 is connected and communicates with a respective one of the second spouts 312. Therefore, the pockets 210 communicate with the third branches 1333 respectively.

In another embodiment, the integration connector may connect two wraps 20 to one main body 10. Precisely, the second part of the integration connector is a splitter. The number of the second spouts is twice than that of the first spouts, and each one of the first spouts communicates with respective two of the second spouts. Therefore, two limbs of a person can be compressed via the present invention at the same time.

In a preferred embodiment, the present invention may comprise two wraps, and each one of the wraps has two water bags. Correspondingly, tube assembly has four inlet tubes and four outlet tubes to connect the water bags.

With the aforesaid structure, the compression device according to the present invention not only can compress a human limb, but also can massage the human limb. Besides, the compression device, the present invention also can serve as a cold compress to the human limb.

Precisely, please refer to FIGS. 1 and 4, after the wrap 20 is wrapped on a part of the human limb, the air pump 12 may be turned on and the controller 136 may control the first valves 132 and the second valves 135 to open or close. In the beginning, the controller 136 makes at least one of the first valves 132 open and the second valve(s) 135 communicating with said first valve(s) 132 closed so that the air pump 12 pumps air to sequentially flow through the main conduit 1341, the said first valve(s) 132, the air connector 133(*s*) communicating with said first valve(s) 132, and the pocket(s) 210 communicating with said first valve(s) 132. Because said second valve(s) 135 is/are closed, the pressure in said pocket(s) 210 may be accumulated to compresses the wrapped human limb. After said pocket(s) 210 compress(es) the human limb for a while, the controller 136 makes said first valve(s) 132 closed and said second valve(s) 135 open, thereby releasing air in said pocket(s) 210 via said second valve(s) 135 and stopping compressing said wrapped part human limb.

By repeating the aforesaid process for several times or via different pocket(s) 210, first valve(s) 132, and second valve(s) 135, the wrapped part of the human limb may be treated as massaging, which helps the wrapped part of the human limb to relax and recover. However, in another embodiment, the pockets may be inflated and deflated via the first valves 132, so the valve assembly may not have the second valves 135.

Please refer to FIG. 1. The water bag is capable of cooling the wrapped part of the human limb. Precisely, with the reserving bag 40 containing water and ice, the water pump 14 may draw the iced water from the reserving bag 40 via the drawing tube 34 and then push the iced water into the bag body via the inlet tube 36. Therefore, the iced water may flow along the flow path in the bag body and cool the wrapped part of the human limb, and then flow out via the outlet tube 37. After that, the water flows back to the reserving bag 40 via the draining tube 35.

In another embodiment, the tube assembly 30 has multiple inlet tubes 36 and multiple outlet tubes 37. Correspondingly, the water bag 22 may have multiple pockets connected to a respective one of the inlet tubes 36 and a respective one of multiple outlet tubes 37, or the wrap 20 has multiple water bags 22 enclosed in the air bag 21 and each water bags 22 is connected to a respective one of the inlet tubes 36 and a respective one of multiple outlet tubes 37. Therefore, the flow path of the iced water is shorter and thereby the iced water can be kept in low temperature.

Please refer to FIGS. 7 to 10. In the second embodiment, the compression device comprises a main body 10, two wraps 20A, and a tube assembly 30, and selectively comprises a reserving bag. However, an amount of the wraps 20A is not limited thereto. Therefore, in the second embodiment, the compression device can compress two human limbs, e.g., two legs or two arms, at the same time.

In order to inflate two wraps 20A, the integration connector 31A may comprises a trunk part 313A and two branch parts 315A. In another embodiment, an amount of the branch parts 315A is equal to the amount of wraps 20A. In the second embodiment, the trunk part 313A may comprise a main part 3131A and a manifold part 3132A detachable mounted on said main part 3131A. The structure of the main part 3131A may be the same as the first part 313 in FIG. 6. The first spouts 311 are mounted on the trunk part 313A.

Each one of the branch parts 315A is mounted on the trunk part 313A. In this embodiment, each branch part 315A is detachable mounted on manifold part 3132A. In another embodiment, the branch parts 315A may be securely mounted on the manifold part 3132A, or the branch parts 315A and the manifold part 3132A are formed integrally, but it is not limited thereto. The second spouts 312 are mounted on each one of the branch parts 315A. In the second embodiment, the structure of each branch part 315A may be the same as the second part 314 in FIG. 6. An amount of the second spouts 312 on each branch part 315A is equal to each other, and equal to an amount of the first spout 311 on the trunk part 313A. In other words, each one of the first spouts 311 communicates with a respective one of the second spouts 312 on one of the branch parts 315A and a respective one of the second spouts 312 on the other one of the branch parts 315A. Therefore, the corresponding pockets of two wraps 20A may be inflated at the same time, which may compress the same parts of the two legs.

With the manifold part 3132A detachably mounted on the main part 3131A and the main part 3131A being the same as the first part 313 in FIG. 6, the user may equip the manifold part 3132A on the main part 3131A to compress two legs, or, alternatively, equip the second part 314 in FIG. 6 on the main part 3131A to compress only one leg.

In the second embodiment, each one of the wraps 20A may comprise two water bags 22A, but an amount of the water bags 22A is not limited thereto. Each one of the water bags 22A is covered by at least one of the pocket 210. One inlet tube 36 connects the main body 10 and a respective one of the water bags 22A, and one outlet tube 37 also connects the main body 10 and a respective one of the water bags 22A. In other words, an amount of the inlet tubes 36 is four, and an amount of the outlet tubes 37 is four, too. Consequently, the compression device of the present invention has multiple pockets 210 isolated from each other, so each pocket 210 can compress a part of a human limb independently. With the independent pockets 210, the compression device may compress a specified part of the human limb rather than the whole wrapped human limb. Moreover, with the pockets 210 independently compressing and relaxing, the wrapped part of the human limb may experience a massage, which helps the wrapped part of the human limb to relax and recover.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A compression device comprising:
a main body comprising:
an air pump; and
a valve assembly connected to the air pump and comprising:
a manifold connected to the air pump; the manifold comprising:
an inlet connected to the air pump; and
a plurality of outlets communicating with the inlet;
a plurality of first valves connected to the outlets respectively;
a plurality of air connectors connected to the first valves respectively; each one of the air connectors comprising:
a first branch connected to a respective one of the first valves;
a second branch communicating with the first branch; and
a third branch communicating with the first branch and the second branch; and
a plurality of second valves connected to the second branches of the air connectors respectively, and selectively connecting the air connectors to an exterior environment;
at least one wrap configured to wrap a human limb and comprising:
an air bag forming an enclosed inner space to receive the human limb, and the air bag comprising:
a plurality of pockets isolated from each other and connected to the third branches of the air connectors respectively.

2. The compression device as claimed in claim 1, wherein the valve assembly further comprises:
a pressure sensor connected to the air connectors.

3. The compression device as claimed in claim 2, wherein each one of the air connectors further comprises:
a tributary communicating with the third branch and connected to the pressure sensor.

4. The compression device as claimed in claim 1 further comprising:
a reserving bag configured to contain water;
wherein:
the main body further comprises:
a water pump connected to the reserving bag; and
each one of the at least one wrap further comprises:
at least one water bag mounted on an inner wall of the inner space of the air bag and connected to the water pump.

5. The compression device as claimed in claim 3 further comprising:
a reserving bag configured to contain water;
wherein:
the main body further comprises:
a water pump connected to the reserving bag; and
each one of the at least one wrap further comprises:
at least one water bag mounted on an inner wall of the inner space of the air bag and connected to the water pump.

6. The compression device as claimed in claim 4, wherein each one of the at least one water bag comprises:
a bag body;
a plurality of partitions mounted in the bag body;
wherein a winding flow path is formed in the bag body via the partitions.

7. The compression device as claimed in claim 5, wherein each one of the at least one water bag comprises:
a bag body;
a plurality of partitions mounted in the bag body;
wherein a winding flow path is formed in the bag body via the partitions.

8. The compression device as claimed in claim 1, wherein the pockets are arranged in a line and each one of the packets is capable of enclosing a part of the human limb.

9. The compression device as claimed in claim 7, wherein the pockets are arranged in a line and each one of the packets is capable of enclosing a part of the human limb.

10. The compression device as claimed in claim 1 further comprising a tube assembly, the tube assembly comprising:
an integration connector comprising:
a plurality of first spouts; and
a plurality of second spouts, each one of the second spouts communicating with one of the first spouts;
a plurality of first tubes, each one the first tubes connecting to a respective one of the first spouts and a respective one of the air connectors; and
a plurality of second tubes, each one of the second tubes connecting to a respective one of the second spouts and a respective one of the pockets.

11. The compression device as claimed in claim 9 further comprising a tube assembly, the tube assembly comprising:
an integration connector comprising:
a plurality of first spouts; and
a plurality of second spouts communicating with the first spouts respectively;
a plurality of first tubes, each one the first tubes connecting to a respective one of the first spouts and the third branch of a respective one of the air connectors; and
a plurality of second tubes, each one of the second tubes connecting to a respective one of the second spouts and a respective one of the pockets.

12. The compression device as claimed in claim 10, wherein the integration connector further comprises:
a first part, the first spouts mounted on the first part; and
a second part detachably mounted on the first part and the second spouts mounted on the second part.

13. The compression device as claimed in claim 11, wherein the integration connector further comprises:
a first part, the first spouts mounted on the first part; and
a second part detachably mounted on the first part and the second spouts mounted on the second part.

14. A compression device comprising:
a main body comprising:
an air pump; and
a valve assembly connected to the air pump and comprising:
a manifold connected to the air pump; the manifold comprising:
an inlet connected to the air pump; and
a plurality of outlets communicating with the inlet;
a plurality of first valves connected to the outlets respectively; and
a plurality of air connectors connected to the first valves respectively;
at least one wrap configured to wrap a human limb and comprising:
an air bag forming an enclosed inner space to receive the human limb, and the air bag comprising:
a plurality of pockets isolated from each other and connected to the air connectors respectively; and a tube assembly comprising:

an integration connector comprising:

a plurality of first spouts; and a plurality of second spouts, each one of the second spouts communicating with one of the first spouts;

a plurality of first tubes, each one the first tubes connecting to a respective one of the first spouts and a respective one of the air connectors; and a plurality of second tubes, each one of the second tubes connecting to a respective one of the second spouts and a respective one of the pockets; wherein:

an amount of the at least one wrap is two;

the integration connector further comprises:

a trunk part, the first spouts mounted on the trunk part; and two branch parts, each one of the branch parts mounted on the trunk part and the second spouts mounted on each one of the branch parts; each one of the first spouts communicating with a respective one of the second spouts on one of the branch parts and a respective one of the second spouts on the other one of the branch parts; and each one of the second tubes connecting to a respective one of the second spouts on each one of the branch parts and a respective one of the pockets of each one of the wraps.

15. The compression device as claimed in claim 11, wherein:

an amount of the at least one wrap is two;

the integration connector further comprises:

a trunk part, the first spouts mounted on the trunk part; and two branch parts, each one of the branch parts mounted on the trunk part and the second spouts mounted on each one of the branch parts; each one of the first spouts communicating with a respective one of the second spouts on one of the branch parts and a respective one of the second spouts on the other one of the branch parts; and each one of the second tubes connecting to a respective one of the second spouts on each one of the branch parts and a respective one of the pockets of each one of the wraps.

16. The compression device as claimed in claim 8, wherein a contour of the air bag is in a boot shape.

17. The compression device as claimed in claim 15, wherein a contour of the air bag is in a boot shape.

* * * * *